United States Patent [19]

Scholz

[11] 4,445,847

[45] May 1, 1984

[54] PHOTOFLASH LAMP

[75] Inventor: John A. Scholz, Danvers, Mass.

[73] Assignee: GTE Products Corporation, Stamford, Conn.

[21] Appl. No.: 382,323

[22] Filed: May 26, 1982

[51] Int. Cl.[3] ..... F21K 5/02

[52] U.S. Cl. ..... 431/362

[58] Field of Search ..... 431/358, 362

[56] References Cited

U.S. PATENT DOCUMENTS

| | | | |
|---|---|---|---|
| 3,303,674 | 2/1967 | Anderson . | |
| 3,310,968 | 3/1967 | Buzalski . | |
| 3,336,646 | 8/1967 | Chauvin . | |
| 3,439,992 | 4/1969 | Shaffer et al. . | |
| 3,602,619 | 8/1971 | Van der Tass et al. . | |
| 3,630,650 | 12/1971 | Kaufmann . | |
| 3,706,522 | 12/1972 | Shaffer et al. . | |
| 3,717,432 | 2/1973 | Demchock . | |
| 3,734,678 | 5/1973 | Liepert . | |
| 3,955,866 | 5/1976 | Vreeswijk et al. . | |
| 4,097,220 | 6/1978 | Cote et al. | 431/362 |
| 4,388,065 | 6/1983 | Martens | 431/362 |

OTHER PUBLICATIONS

Translation of German Utility Model 7,029,839, (May 30, 1973).

*Primary Examiner*—Carroll B. Dority, Jr.
*Attorney, Agent, or Firm*—Lawrence R. Fraley

[57] ABSTRACT

A photoflash lamp, particularly a miniature flashlamp, having improved light output and comprising an envelope having a base portion with an inner concave shape with a pair of spaced leads positioned within the base. A primer is deposited in the envelope on the concave surface over the base and extending leads. A combustible metal shred mass is precompressed externally of the envelope to a diameter less than the internal diameter of the envelope and is constructed with sufficient resiliency whereby the precompressed mass partially expands within the envelope to provide minimal though effective support of the shred mass therein while at the same time providing a relatively unobstructed clearance about the shred mass between the mass and internal surfaces of the side walls of the envelope to assure enhanced ignition of the mass.

8 Claims, 2 Drawing Figures

PHOTOFLASH LAMP

DESCRIPTION

1. Technical Field

The present invention relates in general to photoflash lamps, and pertains, more particularly, to photoflash lamps of the electrically-activated variety. Even more particularly, the invention applies to miniature photoflash lamps (those having an envelope with an internal volume less than or equal to about 1.00 cubic centimeter).

2. Background

A typical photoflash lamp comprises a hermetically-sealed, light-transmitting glass envelope containing a filamentary combustible material, such as shredded zirconium or hafnium foil, and a combustion-supporting gas, such as oxygen. In miniature lamps, the glass envelope typically has a tubular shape with the aforementioned internal volume equal to or less than 1.00 cubic centimeter. In subminiature lamps, to which the invention may also be directed, the internal volume is equal to or less than about 0.300 cubic centimeter (e.g., 0.100 cubic centimeter). In some lamps, particularly those adapted for battery-operated (low-voltage) flash systems, the envelope also contains an electrical ignition system which may take on one of many different forms. One way of providing ignition is to coat the lead-in wires with a primer material with the lead-in wires being positioned so as to project into the shred mass of the lamp. This lead-in wire coating technique is used in, for example, the S-1 type lamp. Another technique is to provide a means for directing the violently projected, ignited primer particles into the shred mass. Such a technique is used, for example, in the well-known percussive product sold under the name Magicube, said product produced and sold by the assignee of the instant invention.

The aforementioned prior art techniques of ignition have limitations associated therewith. These limitations are more pronounced when applied in a sub-miniature or miniature flash lamp. For example, in the technique wherein the lead-in wires are coated with a primer, the protruding wires may act as a medium for "shorting out" through the shred if any of the shred material comes in contact with an uncoated section of the lead-in wires. This in turn may prevent primer ignition. Furthermore, even if the primer ignites and shred burn occurs, there may be subsequent lead meltdown or vaporization with attendant wall darkening and consequent loss of light output.

The other aforementioned technique of projecting ignited primer particles into the shred mass also has disadvantages associated therewith, said disadvantages caused primarily by the high velocity gas flow entering the region that contains the shreds of light-emitting material. Such problems have been addressed in U.S. Pat. Nos. 3,439,992 and 3,706,522, for example.

In addition to the aforementioned problems associated with shred mass ignition, there is the associated problem of providing complete and rapid shred combustion, particularly in the vicinity of the lamp walls. This inability to provide shred ignition up and along the lamp walls is due to the extensive contact made by the many shreds with the envelope's internal glass walls, thereby inhibiting the free flow of ignited primer particles along the lamp walls. As a result, it has been typical in the prior art that ignition of the shred mass occurs in the immediate vicinity of the primer and then steadily burns from one end of the lamp to the other with the burning occurring at an unpreferred, relatively slow rate. In U.S. Pat. No. 3,630,650, a flash lamp is described in which the shred mass is formed by impacting the shred filaments against a stationary surface so as to induce sharp bends and eventually form many wads of fill material from multiple pieces of shred. In this patent, the technique is described as minimizing the bearing area of the combustible material on the inner surface of the bulb wall, and extending the peak time of a given flash lamp.

In U.S. Pat. No. 3,955,866, it is disclosed that precompacting of shred material is possible for eventual use in a photoflash lamp. It is noted, however, that in this patent, the step of annealing of the shred material is required so as to increase the time which transpires between the instant at which the first strip ignites and the period at which light intensity is maximum. This annealing step, of course, fixes the configuration of the shred mass and does not lend itself to permitting the free flow of ignited primer particles along the lamp wall.

DISCLOSURE OF THE INVENTION

Accordingly, it is an object of the present invention to provide a photoflash lamp constructed to provide improved and more complete ignition. In accordance with the invention, ignited primer particles in turn cause more complete and rapid shred combustion. This is brought about to a great extent by improvements in lamp configuration and primer placement within the lamp envelope.

Another object of the present invention is to overcome some of the aforementioned problems associated with incomplete or delayed ignition or combustion of the shred mass. In accordance with the invention, the combustible shred mass has been preformed into a cylindrical mass and then located in the envelope, said mass thus of a configuration so as to encourage the free flow of ignited primer particles along and up the lamp envelope's internal sidewalls in order to reduce the lag time (period of time between primer ignition and maximum light output) and also to decrease the total time interval of light output.

To accomplish the foregoing and other objects of this invention there is provided a photoflash lamp which comprises a hermetically-sealed, light-transmitting envelope having a base with an inner concave shape and circumferentially-disposed sidewalls. A pair of spaced leads extend through the envelope base and may either be flush with the inner surface of the base or extend very slightly into the envelope. A primer is disposed in the envelope on the concave surface base and in contact, both physical and electrical, with the leads. This primer preferably is disposed only at the base and does not extend to any great extent up either of the sidewalls. There is provided a combustible metal shred mass which is precompressed externally of the lamp envelope to a diameter less than the inner diameter of the envelope. The shred mass is non-annealed, but instead maintains a resiliency so that the precompressed mass partially expands in the envelope to provide limited support of the shred mass therein, while at the same time providing a relatively unobstructed clearance between the shred mass and envelope's internal walls to enhance ignition along the sidewall of the envelope.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
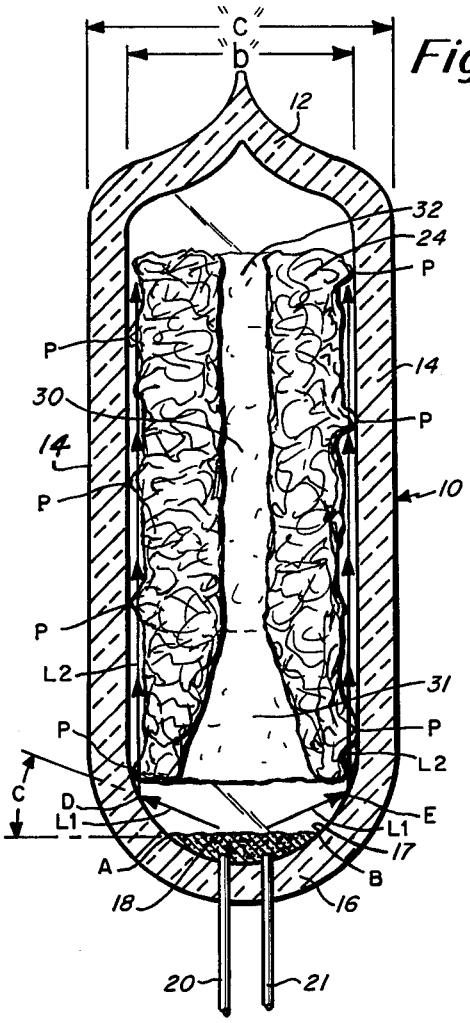
FIG. 1 is an enlarged elevational view, in section, of an electrically-activated photoflash lamp in accordance with the principles of the present invention.

FIG. 1 is a sectional elevation view of a miniature photoflash lamp constructed in accordance with the principles of the present invention and comprising a miniature flash lamp envelope 10 having a tip portion 12, opposed (in cross-section) tubular sidewalls 14, and a concave (or cup-shaped) base portion 16. The base 16 has an inner, concave or semi-circular surface 17 upon which the primer 18 is deposited. The primer 18 preferably extends to only partially cover the base to points A and B on the surface 17. Primer 18 is preferably a composition of zirconium and potassium perchlorate (the zirconium constituting about 85% by weight of the total composition). It is understood, however, that any primer composition known in the art and capable of being ignited by the power source typically associated with many of today's cameras may be utilized. A typical example of such a source is a piezoelectric element producing a high voltage, low energy pulse approaching in some instances 5000 volts. From about 1.0 to about 1.50 milligrams of primer were utilized in an envelope having an internal volume of about 0.100 cubic centimeter.

The preferred glass material for envelope 10 is sold by the assignee of the instant invention under the product designation SG10 and is a potash soda lead glass having a typical chemical composition, by weight, of about 61% silica dioxide, 21.5% lead oxide, 7.7% sodium oxide, 7.45% potassium oxide, 2.1% alumina oxide, 0.15% arsenic trioxide and 0.1% calcium oxide. SG10 glass also has a thermal expansion rating of 93.1, an annealing point of about 432 degrees Celsius, a softening point of about 626 degrees Celsius, and a dielectric constant of 6.7. While the above material is preferred, it is understood that other soft glsses heretofor used in the photoflash industry, e.g., soda lime glasses, could also be used with the invention as well as the harder glasses, e.g., quartz and borosilicate.

FIG. 1 also shows the two leads 20 and 21 which extend through the base 16 into the hollow, cylindrical envelope. These leads, preferably of a nickel-iron alloy having a diameter of 0.016 inch, very slightly protrude past the inner glass surface 17 into the envelope. While both leads are shown as passing through the base portion of envelope 10, it is also possible in the invention to slightly recess the extreme end segments of each wire within the base. In other words, it is only necessary in the invention that the extreme end segments have access to the envelope's interior such that the described primer composition may be located in contact therewith. In constructing the photoflash lamp, the finished primer 18 is dry, although, as stated below, is applied in wet form. When a piezo pulse is applied across the two leads 20, 21, the primer suspension mixture 18 almost instaneously ignites. During this ignition, particles of ignited primer material are ejected, with many of them being ejected at an elevated angle of on the order of 10°–20° from the primer surface. This is illustrated in FIG. 1 by angle C. These relatively low-angle ignited primer particles follow the path depicted by line L1 in FIG. 1 coming in contact, illustratively, with surface 17 at points D and E. Points D and E are just below the point where the straight tubular section of the envelope starts. FIG. 1 also shows the manner in which these ignited primer particles leave points D and E and extend substantially vertically along (parallel) and adjacent the upstanding tubular sidewalls 14 between the shred mass (24) and said sidewalls. Thus, due to the velocity with which the primer particles are expelled and because of the curvature of the base surface, the particles travel along the lamp envelope's internal sidewall and continue toward tip portion 12.

The path of travel along line L2 about essentially the entire outer perimeter of the shred mass provides improved ignition of shred mass 24. Thus, not only is the surface of the shred mass directly opposite to the primer rapidly ignited, but also, due to the deflections illustrated in FIG. 1, there are provided many more locations of shred combustion. In essence, there has been an enhancement in the distribution of ignited primer to many different regions of the lamp envelope. The described several locations for ignition are, as shown, along the external portion of mass 24 and even at the top (upper) end portion's external region (that nearest tip portion 12) by virtue of the additional deflection of some ignited particles from the internal wall of portion 12 downwardly onto said region. Accordingly, some ignited primer particles are subjected to at least two deflections within envelope 10. When ignited, the invention is capable of providing a light output within the range of about 600 lumen-seconds to about 2000 lumen-seconds. The invention is thus ideally suited for use with camera's using today's more sensitive and/or higher speed (e.g., ASA 400 or 600) films.

Accordingly, it is seen that the combination of the described lamp base geometry illustrated in FIG. 1 and the minimal contact, pre-stressed shred mass used within the envelope makes it possible to provide as unobstructed a path as possible for the ignited primer particles as they pass in the direction of line L2 illustrated in FIG. 1, thereby providing enhanced shred ignition.

Figure 2:
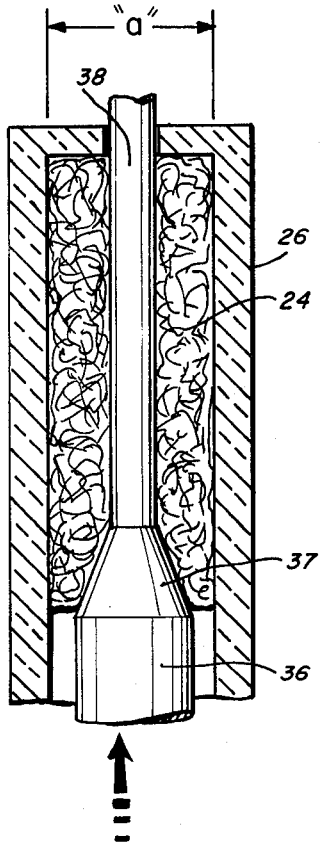
FIG. 2 illustrates one example of the apparatus employed in providing pre-compacting of the shred material to be employed in the photoflash lamp depicted in FIG. 1.

In FIG. 1, the shred mass 24 is constructed of zirconium or hafnium shreds and in accordance with the invention, is preformed into a cylindrical mass externally of envelope 10 prior to positioning therein. The preforming or pre-packing of the shred mass is accomplished by dispensing a pre-weighted (e.g., from about 3 to 8 milligrams) mass of shred into a length of cylindrical glass tubing 26, as illustrated in FIG. 2, having an internal diameter, "a", of about 0.115 inch. Each of the shreds may have a rectangular, cross-sectional dimension of 0.0007 inch by 0.0009 inch, and a 4.00 inch length. The shred mass 24, as illustrated in FIG. 2, may be compressed in the tube 26 using a solid, cylindrical rod (not shown) having a continuous diameter of about 0.107 inch, or in other words, slightly less than the internal diameter of tubing 26. Such a compressing rod is used for an embodiment wherein the shred mass is solid (non-voided). The compacted mass is then transferred to a previously-primered (with leads 20, 21 therein), open-ended lamp body having in its tubular section an outer diameter, "c", of about 0.200 inch and an inner diameter, "b", of about 0.150 inch. Thus, the inner diameter of the envelope is 0.150 inch, but the shred mass is compacted to a diameter slightly less (0.115 inch). However, once compacted in glass tubing 26, the shred mass is not annealed or similarly treated, and the natural resiliency of the shred mass fibers provide for sufficient expansion of surprisingly, only a few of the fibers so as to hold the cylindrically-formed shred mass in place within the lamp once the mass is inserted (e.g., air blown) therein, and yet allow for sufficient clearance for ignition along the sidewalls of the lamp. FIG. 1 illustrates the points P where, due to the fiber resiliency, only a small number of the shred mass fibers provide minimal but effective contact with the inner surface of the lamp sidewalls 14. The lamp is subsequently "necked down", filled with oxygen or similar combustion-supporting gas, and "tipped off" utilizing a technique known in the art. The oxygen is established at several (e.g., 8–12) atmospheres pressure. The overall length (internal) of the completed envelope is about 0.5 inch.

With the limited-point contact of mass 24 illustrated in FIG. 1, upon ignition of the primer material, the ignited primer particles not only ignite the shred material immediately opposite primer 18, but also deflect upwardly alongside the sidewalls to thereafter ignite the shred material at the described number of different, spaced locations. Because of the limited point contact due to the shred compaction and its resiliency, there is a relatively unobstructed path along the inner surface of the sidewall along which the ignited shred material may pass. This yields a flash lamp having the desired characteristics of decreased lag time, decreased peak time, and decreased light output interval while, at the same time, increasing total light output. Total light output is increased primarily due to the described minimal contact between the shred mass and glass walls of the envelope, said minimal contact significantly reducing the opportunity for quenching of shred combustion by the relatively cool glass walls during ignition of the mass. Such quenching not only diminishes total output but has also proven in the past to cause variations therein.

In accordance with one embodiment of the present invention, not specifically illustrated herein, shred mass 24 may be in the form of a continuous (solid), cylindrical form (similar to that shape in FIG. 1 without the central void). FIGS. 1 and 2, however, illustrate a variation wherein the central portion of the shred mass is contoured to further augment total shred surface exposure to ignited primer particles. Thus, as illustrated in FIG. 1, there is a centrally disposed void section 30 including a first conical section 31 at the bottom (adjacent primer 18), and an elongated cylindrical section 32 extending from conical section 31 to the top of mass 24. These sections are connected voids, as described and shown, through which ignited primer particles also travel to thus almost simultaneously ignite a large number of shreds and cause such ignition rapidly. FIG. 2 illustrates the use of a ramrod 36 having a conical section 37 and a cylindrical section 38 to match the like void sections previously referred to. The diameter of the cylindrical rod section 38 is 0.031 inch, thus providing a cylindrical void section 30 of approximately the same size. Thus, with a single ramrod 36 configured in the manner depicted in FIG. 2, there can be provided both conical and cylindrical void sections with the ramrod while at the same time providing pre-compacting of the shred mass. The invention is thus ideally suited for being manufactured on a mass production basis at relatively low cost.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electrically-activated photoflash lamp comprising:

a hermetically sealed, light-transmitting substantially cylindrical envelope having a base portion with an inner, substantially concave surface, and opposed upstanding sidewalls extending therefrom;

a pair of spaced leads positioned within said base portion and having end portions each having access to the interior of said envelope;

a quantity of primer material positioned on said concave surface of said base portion in contact with said end portions of said leads; and a combustible metal shred mass precompressed externally of said envelope to a diameter less than the inner diameter of the envelope and thereafter inserted within said envelope, said shred mass having resiliency whereby the precompressed mass only partially expands within the envelope to provide minimum contact support of the shred mass in the envelope while at the same time providing a relatively unobstructed clearance about the shred mass between the shred mass and internal surfaces of said upstanding sidewalls of said envelope for ignition of said mass along said sidewalls of the envelope, said shred mass including a substantially central void section extending longitudinally therethrough.

2. A photoflash lamp as set forth in claim 1 wherein said base portion of said envelope has an inner, semi-circular surface contiguous with said internal surfaces of said sidewalls, said quantity of primer material oriented below the interface between said base portion and said sidewall surfaces.

3. A photoflash lamp as set forth in claim 1 wherein the materal of said combustible metal shred mass is selected from the group consisting of zirconium and hafnium.

4. A photoflash lamp as set forth in claim 1 wherein said substantially central void section includes a lower, conical section and an upper, cylindrical section, said conical section being positioned adjacent said quantity of primer material.

5. A photoflash lamp as set forth in claim 1 wherein each of said spaced leads is of a nickel-iron alloy.

6. A photoflash lamp as set forth in claim 1 further including a combustion-supporting atmosphere within said envelope.

7. A photoflash lamp as set forth in claim 6 wherein said atmosphere is oxygen.

8. A photoflash lamp as set forth in claim 1 wherein said shred mass is not subjected to annealing prior to insertion within said envelope.

* * * * *